United States Patent [19]

Black

[11] 4,223,511

[45] Sep. 23, 1980

[54] PVC FOIL CUTTER

[75] Inventor: John W. Black, Hickory Corners, Mich.

[73] Assignee: Pemco-Kalamazoo, Inc., Kalamazoo, Mich.

[21] Appl. No.: 21,621

[22] Filed: Mar. 19, 1979

[51] Int. Cl.[3] ..... B65B 41/16; B65B 67/10

[52] U.S. Cl. ..... 53/390; 53/201; 53/389; 83/577

[58] Field of Search ..... 53/389, 390, 211, 213, 53/201; 83/577, 576, 575

[56] References Cited

U.S. PATENT DOCUMENTS

| | | | |
|---|---|---|---|
| 3,058,273 | 10/1962 | Forman et al. | 53/390 X |
| 3,381,450 | 5/1968 | Monks | 53/390 |
| 3,475,880 | 11/1969 | Bickham et al. | 53/389 X |
| 3,563,003 | 2/1971 | Pizmoht | 53/390 |
| 3,722,177 | 3/1973 | Michels | 53/390 |
| 3,724,167 | 4/1973 | Pizmoht | 53/390 |

*Primary Examiner*—Horace M. Culver
*Attorney, Agent, or Firm*—Blanchard, Flynn, Thiel, Boutell & Tanis

[57] ABSTRACT

A severing device for use in a semiautomatic machine for facilitating the wrapping of an article with thermoplastic film material. The device is designed as an adapter to fit into a presently known machine to permit the removal of the hot wire presently used in such machines for severing the film and to replace such hot wire by a mechanical device for this purpose whose location and operation will not appreciably, if any, require alteration of the manual sequence previously known for effecting such wrapping. The device includes a knife and knife bed assembly which is relatively movable by electrical means. At least one limit switch is positioned adjacent the meeting zone of the knife and knife bed assembly so that upon movement of the thermoplastic film downwardly by the same motion as previously placed same against the hot wire for severing, the film will contact and actuate the limit switch and thereby actuate the knife and knife bed assembly for effecting such severing. A hot plate for sealing is positioned on the adapter in a position substantially similar to that in which it was placed on the original machine and is accordingly available to function in the same manner as previously known.

9 Claims, 5 Drawing Figures

PVC FOIL CUTTER

FIELD OF THE INVENTION

The invention relates to apparatus for facilitating the hand wrapping in thermoplastic film material of various items of merchandise, which apparatus provides for feeding of the film from a continuous roll thereof, a surface for the preliminary wrapping of an item, means for severing the film after partial wrapping and means for effecting final sealing of the wrapped package. The invention particularly comprises an adapter replaceable into a presently known standard machine of this type whereby a mechanical severing device replaces the previously known hot wire severing means but without appreciably if at all altering the manual movements previously required for effecting a wrapping operation.

BACKGROUND OF THE INVENTION

Apparatus has previously been known for use in connection with wrapping packages in thermoplastic film material which apparatus permitted the manual withdrawal of such film from a continuous roll thereof, facilitated the wrapping thereof partially around the package, severing the wrapped portion from the roll and finally facilitated the completion of the manual wrapping operation and heat sealing of the wrapped package. An example of such a machine is illustrated and described in detail in the patent to Pizmoht, U.S. Pat. No. 3,724,167.

This device, however, in common with many others currently utilized for such wrapping procedures, employs a hot wire for effecting the severing of the film wrapped at a given moment around a package from a continuous roll thereof. This operates satisfactorily but evidence has accumulated suggesting a possible harmful effect on the operator from the use of the hot wire. This is particularly true where the film is of polyvinyl chloride such that the hot wire releases small quantities of HCl gas. It is accordingly desirable to eliminate from the procedure in question the step of severing such film with a hot wire and to replace same with mechanical means by which such gas is not released.

There is, however, a very large number of machines, as aforesaid, already in use and their complete redesign and replacement would be an extremely expensive undertaking. Further, large numbers of operators have been trained in the use of these machines and the particular manual manipulations required by them have been carefully worked out for maximum efficiency over a long period of time. It is therefore desirable that the conversion be made by an adapter which would merely eliminate the hot wire and preserve as much of the original machine as possible and further that such adapter operate in conjunction with the rest of the machine in such a manner as to preserve the sequence of manual manipulations previously used for such previously known machines, such as the machine represented by the above-mentioned patent.

Accordingly, the objects of the invention include:

1. To provide an adapter for utilization with a machine such as that represented by the U.S. patent to Pizmoht, U.S. Pat. No. 3,724,167, whereby the severing of the film material by a hot wire is eliminated and the severing function is performed by mechanical means.

2. To provide apparatus, as aforesaid, comprising an adapter compatible with said previously known machine which will require only easily made modifications of the original machine to enable same to receive and cooperate with said adapter.

3. To provide apparatus, as aforesaid, which in its normal mode of use will not appreciably if any change the sequence of manual manipulations already known and utilized in the operation of the presently known machines.

4. To provide apparatus, as aforesaid, which will be of relatively simple construction and hence inexpensive to manufacture and easy to maintain in good operating condition.

5. To provide apparatus, as aforesaid, which in spite of its dependency upon a relatively moving knife and knife bed assembly will have a high safety factor with respect to the operator.

SUMMARY OF THE INVENTION

In general, the objects and purposes of the invention are met by providing an apparatus having a generally triangularly shaped box for placement adjacent the working surface of, and into the angle of that portion of, the machine of U.S. Pat. No. 3,724,167 presently occupied by the hot wire and sealing plate. The apparatus in the illustrated embodiment comprises a knife holder of relatively rigid material located at least close to the position previously occupied by the hot wire and a pivotally mounted knife bed of relatively soft material which can be moved into and out of cutting relationship with the knife. A pair of limit switches is placed adjacent the knife holder which when closed activates the knife bed and cause same to move toward the knife thereby severing a film lying thereacross. The conventional hot plate is mounted adjacent the knife holder for sealing of the package in the usual manner. The knife holder is spaced from the proximate edge of the working surface sufficiently to permit sheet material to be drawn from a suitable holder therethrough for preliminarily wrapping around an article lying on the working surface. The knife bed is positioned close enough to the proximate edge when in its inactive condition as not to interfere with such manipulation of the sheet material.

Other objects and purposes of the invention will be apparent to persons acquainted with apparatus of this general type upon reading the following specification and inspection of the accompanying drawings.

DETAILED DESCRIPTION

Figure 1:
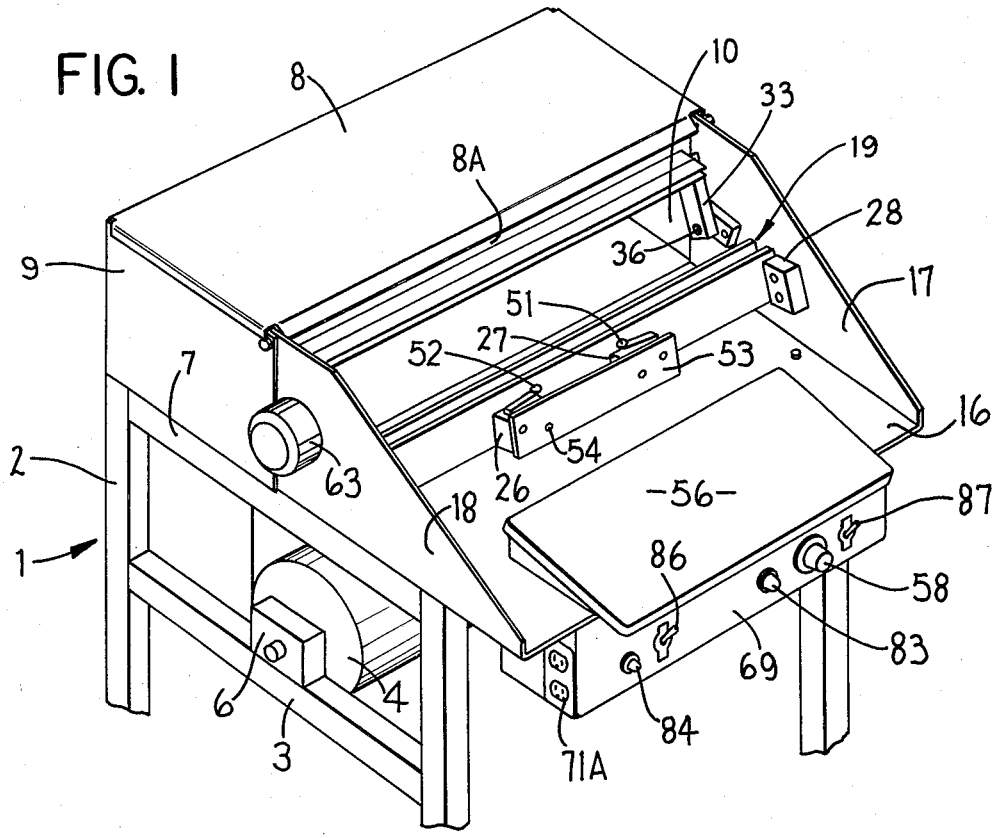
FIG. 1 is an oblique view of a wrapping machine of the type set forth in Pizmoht U.S. Pat. No. 3,724,167 with the adapter of the invention applied thereto.
Figure 2:
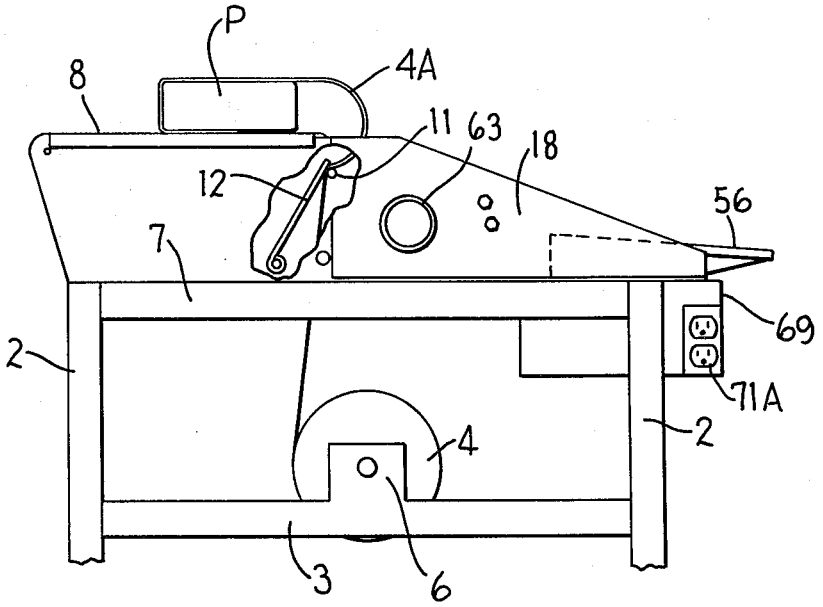
FIG. 2 is a partially broken end view of the machine shown in FIG. 1.
Figure 3:
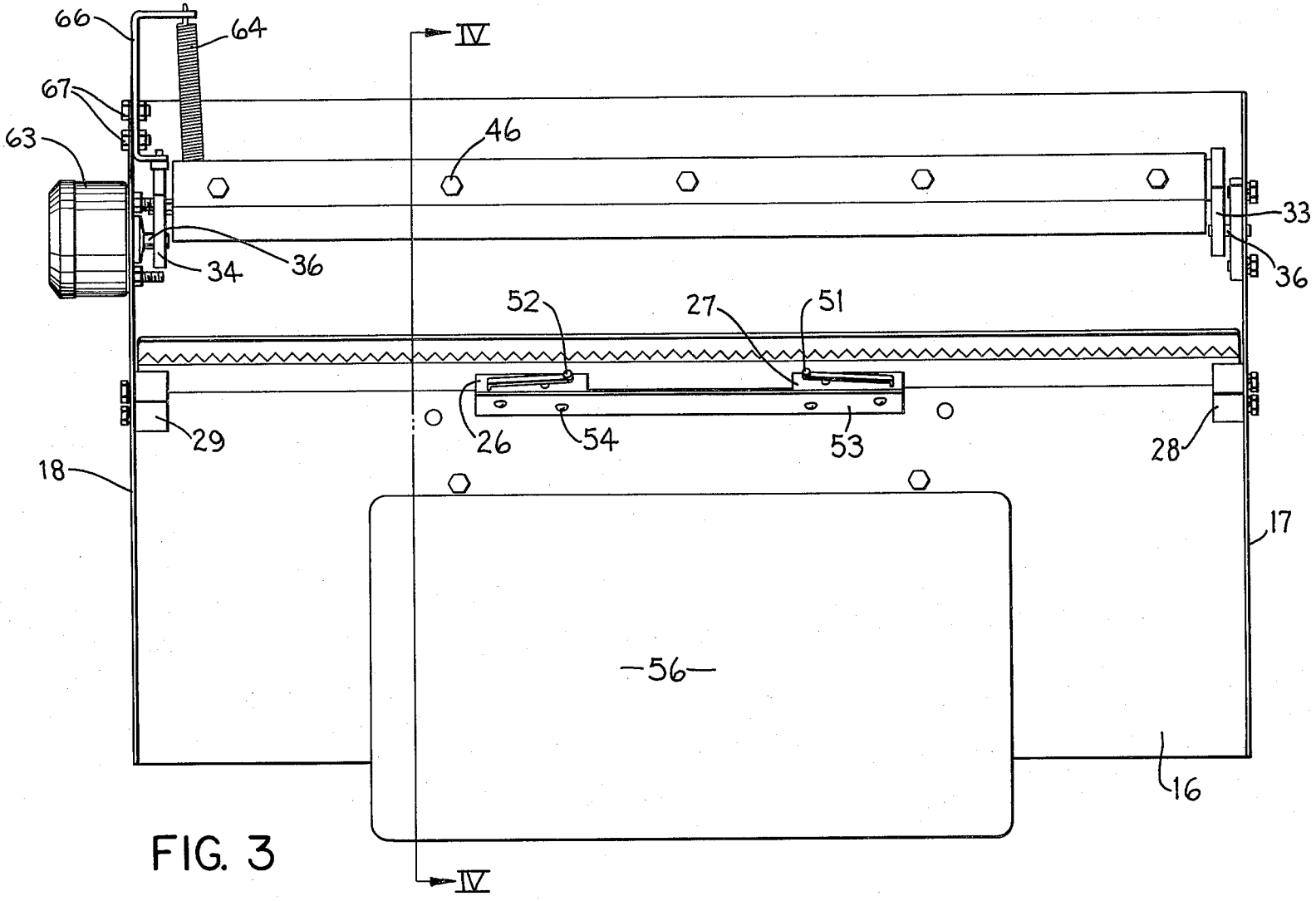
FIG. 3 is a top view of the machine shown in FIG. 1.

Looking first at the presently known apparatus, a brief description thereof will be set forth for convenience in reference herein and to facilitate a full understanding of the invention with reference, however, being invited to the above-mentioned patent to Pizmoht, U.S. Pat. No. 3,724,167, for a more complete and detailed disclosure thereof.

Turning now to the drawings, there is provided a framework 1 which includes vertical members 2 and horizontal members 3. The horizontally members 3 are spaced from each other as desired, normally equally, and are fixed in any desired manner, such as by riveting or welding to the vertical members 2. The vertical members rest upon any desired supports not shown. Rolls of sheet, usually film, material as desired may be mounted upon the several horizontal members, here there being shown only a single roll 4 mounted upon the single horizontal member 3 shown in the drawings. Such roll or rolls are mounted for rotation in any convenient manner such as by the bearing structure 6 which bearing structure, however, in any convenient manner exerts such drag on the roll as to permit its easy rotation when an operator pulls film therefrom but to prevent free rotation of the roll.

Horizontal bars 7 connect the upper ends of the uprights 2 and are arranged for supporting the hereinafter-mentioned further superstructure.

A wrapping table 8 including side members 9 and 10 is positioned on and supported by the frame 1. A friction bar 11 and spring plate 12 guide and hold material drawn from the roll at a point adjacent the forward edge 8A of the table. Thus, material 4A extending from the roll 4 and projecting between the bar and spring guide will be readily accessible to the operator for preliminarily wrapping a package P on the top of the wrapping table 8 and same will be done in the same manner as presently known with the above-mentioned previously conventional equipment.

Turning now to the portion of the apparatus comprising the present invention, there is provided a platform structure 16 having at its edges (in this instance being upturned therefrom) the generally triangular side plates 17 and 18. The side plates are of such height, and so spaced when the device is in operating position as shown in the drawings, that they will constitute substantial continuations of the side plates 9 and 10. A knife assembly 19 extends between and is mounted on the side plates, same being mounted thereon in any convenient manner. In this embodiment, the assembly comprises a knife 21 positioned between a pair of guard blocks 22 and 23, which guard blocks have lips 22A and 23A thereon which together define guards extending beyond and on both sides of the cutting edge of the knife. The guard blocks 22 and 23 are fixed in any convenient manner, as by screws, of which one appears at 24, onto mounting blocks 28 and 29 which are in turn fixed rigidly as by screws respectively to the side plates 17 and 18.

Figure 4:
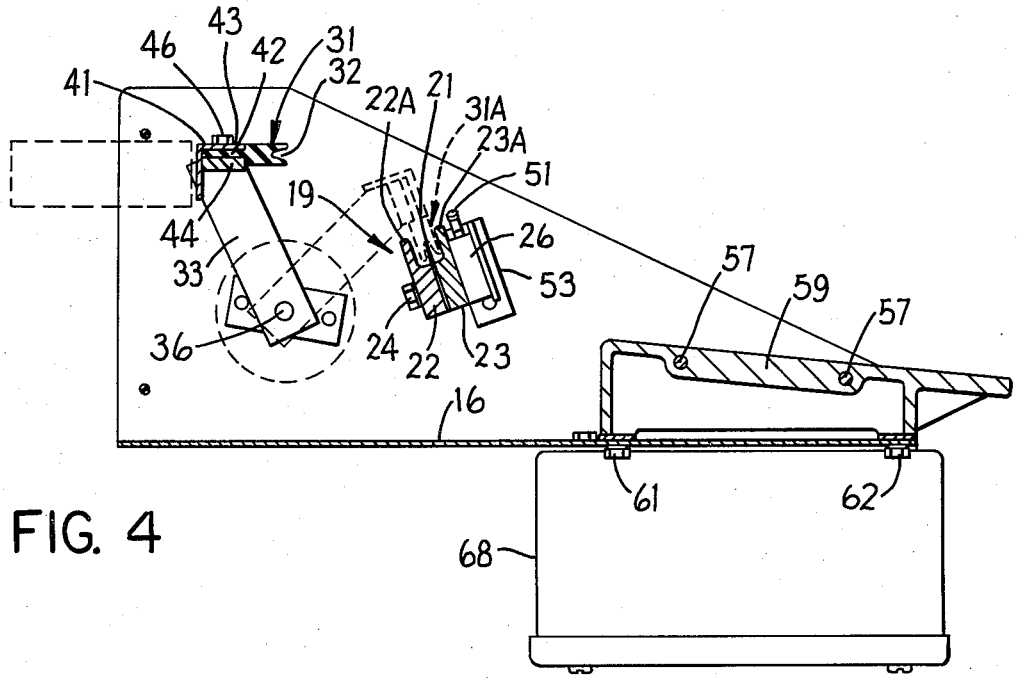
FIG. 4 is a sectional view taken along the line IV—IV of FIG. 3.

A movable knife bed 31 comprises a strip of soft material such as rubber having a groove 32 along the edge thereof and of thickness to enter into the space between the lips 22A and 23A as indicated by the broken lines 31A in FIG. 4. The strip is mounted on a pair of pivot arms 33 and 34 in any convenient manner and the pivot arms are in turn pivotally mounted by suitable pivot means of which one is shown at 36 to the side plates 17 and 18. In the particular example shown in FIG. 4, an angle member 41 extends between the arms 33 and 34 and the movable knife bed 31. The knife bed 31 is provided with a projecting fin 42. In this case, the movable bed 31 is fixed to the angle member 41 by the fin 42 being positioned between the leg 43 thereof and a clamp plate 44, which clamp plate is urged toward and in clamping relationship with said leg 43 by a plurality of screws of which one appears at 46.

The fixed portion of the knife and knife bed assembly, here the knife assembly 19, is spaced sufficiently from the proximate edge 8A of the table as to provide ample space for bringing the wrapping film 4A from the roll 4 up therethrough for wrapping around the package P resting on the table. The movable portion of the knife and knife bed assembly, here the knife bed 31, together with its movable arm supports 33 and 34, is positioned so that when the apparatus is in its at rest position, the knife bed 31 will lie closely adjacent the proximate edge 8A and thus not materially narrow or otherwise obstruct the opening provided as above mentioned.

Supported on the guard block 23 is a pair of blocks 26 and 27, which respectively support limit switches 51 and 52 in close proximity to the knife blade 21. A guard plate 53 is fixed in any convenient manner, as by screws 54, to the blocks 26 and 27 to protect the switch arms of the limit switches 51 and 52 from too much pressure being applied thereto by the material 4A created during the wrapping procedure discussed in more detail below.

A conventional heat sealing plate 56 having the usual heating means, here comprising the elements 57 and 58 in association with the conventional heat sink 59, is mounted as convenient onto the platform 16, as by the screws 61 and 62.

A suitable motor, here a rotary solenoid 63, is mounted on the side plate 18 for rotating the movable cutting bed 31 clockwise as viewed in FIG. 4. A spring 64 is mounted by a bracket 66 and bolts 67 onto the side plate 18 for effecting a return of the movable knife bed 31 to the position shown in FIG. 4 when the solenoid is deactivated. The circuitry for controlling and actuating the above-described apparatus is contained within the box 68 mounted as shown on the underside of the platform 16 and appropriate switches, indicator lights and controls are provided as shown on the front face 69 of said box.

Figure 5:
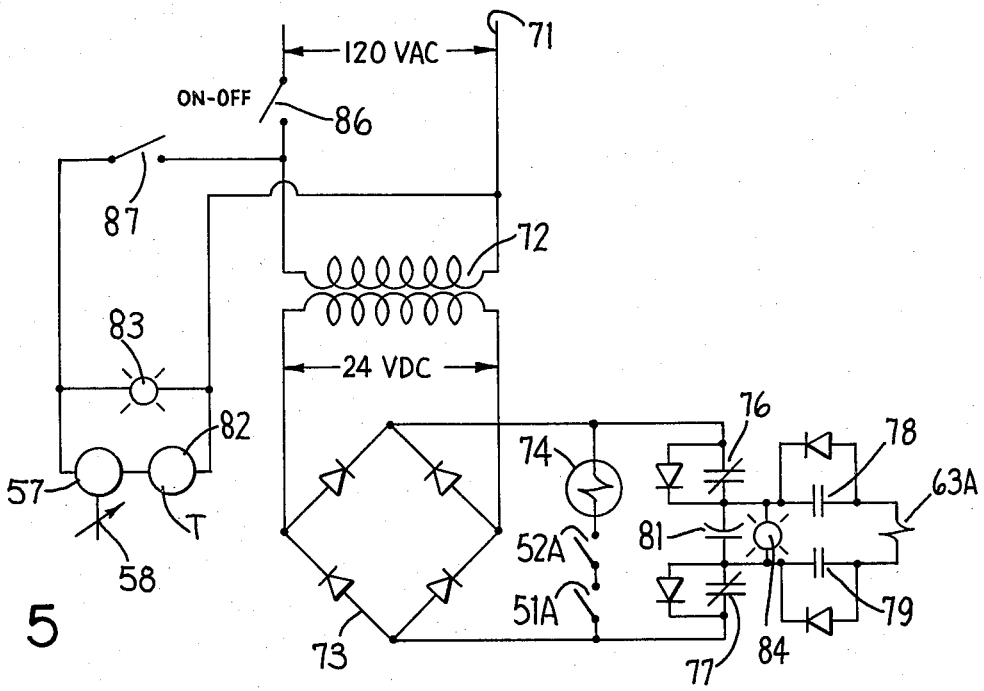
FIG. 5 is a schematic drawing of the electrical circuitry operating the adapter.

Any desired circuitry may be provided for controlling the apparatus but there is shown in FIG. 5 one particularly effective means for so doing. A 120 A.C. volt source 71, indicated in FIG. 1 by the plug-in marked 71A, is connected through a suitable transformer 72 to a rectifier 73. The output of the rectifier is connected through the series connected normally open contacts 51A and 52A of the limit switches 51 and 52, respectively, to the winding 74 of a relay having two normally closed contacts 76 and 77 and two normally open contacts 78 and 79. The output of the rectifier 73 is also connected through the normally closed contacts 76 and 77 to opposite sides of a capacitor 81 and the opposite sides of the capacitor are also connected through the normally open contacts 78 and 79 to the winding 63A of the rotary solenoid 63.

Appropriate rectifiers as shown are provided to damp surges across the contacts in the usual manner. Thus, in the "at rest" position of the apparatus with the relay winding 74 de-energized, the power source will charge the capacitor 81. When the switches 51A and 52A are both closed and the winding 74 is activated, then the charging of the capacitor is terminated and with the closing of the switches 78 and 79 the capacitor discharges with a single but strong pulse through the winding 63A of the rotary solenoid 63. This effects a single operation thereof and the immediate deactivation of the solenoid permits the spring 64 to return the movable knife bed 31 to the position shown in FIG. 4.

The power source 71 is also connected through a suitable timer 82 to the heating means 57 which as schematically indicated by the arrow 58 is preferably adjustable by conventional means including the knob 58 in FIG. 1 to the temperature desired for the sealing table 56. A pilot light 83 may be provided for the heating table and a further pilot light 84 may be provided if desired in parallel with the capacitor 81. A suitable on-off switch 86 may be provided for the whole system and a further on-off switch 87 may be provided if desired for the heater.

OPERATION

With the hot wire, the heating pad, and the electrical components associated therewith, removed from the prior known machine, the components herein described as the subject matter of the invention may be placed bodily into the location of the conventional machine as shown and described above. If, however, in the conventional machine the side plates 9 and 10 extend continuously across the entire sides of the machine, they will either need to be cut off adjacent the edge 8A of the table 8 or if preferable replaced by side plates which as shown terminate adjacent the edge 8A.

With the parts thus assembled as shown, a package to be wrapped may be placed in the usual manner onto the table 8 and an appropriate length of film 4A drawn upwardly past the edge 8A from the roll 4. Same is then laid on top of the package, rotated one-half turn away from the operator and then drawn toward the operator sufficiently that the package is directly over the hot plate 56. At this point the operator crushes the ends of the wrapping which project sidewise beyond the package and moves same downwardly toward but not all the way to the hot plate. This causes the portion of the film adjacent the package to contact the switch arms of the limit switches 51 and 52, which contact is limited by the guard plate 53. This as above described actuates the solenoid and rotates the movable knife bed 31 in a clockwise direction as seen in FIG. 4. This pushes the film down against the knife 21 to sever same after which, the capacitor 81 being now discharged, the spring 64 returns the movable knife bed into its upward position as shown in FIG. 4. The operator now completes the wrapping, folds the ends under the package and moves same further downwardly against the hot place 56 for sealing of same.

Thus, the entire operation proceeds with the same manipulation known to the prior art and, for example, described in detail in Palmer U.S. Pat. No. 3,521,425 but the severing is now accomplished by knife means instead of by the hot wire of the prior art.

It will be noted that the knife edge is fully protected by the rigid, or semirigid, lips 22A and 23A and further that the movable knife bed 31 is of relatively soft material. Thus, even if an operator has a hand or finger in the way of the movable knife bed as it operates, there can be no injury. Further, the immediate discharge of the energy effecting the movement of the movable knife bed and its return to the raised position insure against the operator's hand or finger being held for other than momentarily against the lips 22A and 23A.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In semiautomatic means for facilitating the wrapping of an article in a piece of sheet material, an adapter for cooperating with a conventional table having a working surface and sheet material dispensing means, the improvement comprising in combination:

frame structure positionable in fixed relationship to said working surface;

a power source and electrically actuatable mechanical cutting means energizable thereby spaced from a proximate edge of said working surface to define a space therebetween through which said sheet material may be drawn, said cutting means comprising a fixed portion fixed to said frame structure and a movable portion pivotally mounted on said frame structure in such a manner that in its at rest position it will lie adjacent said proximate edge and be substantially spaced from said fixed portion to facilitate the passage of said sheet material therebetween; and mechanically actuatable means for energizing said cutting means positioned in fixed relationship to said fixed portion of said cutting means on a side of said sheet material remote from said proximate edge;

whereby sheet material may be drawn through said space wrapped around said article on said working surface and the cutting means then actuated by drawing said sheet material over said fixed portion and against said mechanically actuatable means.

2. The device of claim 1, wherein said mechanically actuatable means comprises at least one limit switch mounted in fixed relationship to said frame structure and adjacent the side of said fixed portion of said cutting means remote from said proximate edge.

3. The device of claim 1, including also a heat sealing pad on said frame structure at a portion thereof adjacent said mechanically actuatable means and adjacent the side of said sheet material remote from said proximate edge.

4. The device of claim 1, including electrically chargeable pulse means and a motor actuatable thereby for actuating said movable portion of said cutting means;

whereby said pulse means will be charged from said power source when the device is inactive and upon actuation of said mechanically actuatable means said chargeable means will discharge through said motor for a single actuation of said movable portion of said cutting means.

5. The device of claim 5, including constantly acting resilient means urging the movable portion of said cutting means away from said fixed portion thereof.

6. The device of claim 1, wherein said fixed portion of said cutting means comprises a pair of spaced lips having an upwardly projecting knife positioned therebetween and said movable portion of said cutting means includes a pair of spaced downwardly extending flanges dimensioned to be receivable between said lips and to embrace said knife.

7. The device of claim 6, wherein said lips are of relatively rigid material and said flanges are of relatively flexible material.

8. The device of claim 2, wherein said mechanically actuatable means are mounted onto the fixed portion of said cutting means.

9. The device of claim 1, including also a heat sealing pad on said frame structure at a portion thereof adjacent said mechanically actuatable means and on a side thereof spaced from the proximate edge of said working surface sufficiently to permit sheet material to be drawn from a suitable holder for preliminarily wrapping around an article lying on said working surface, said pad being spaced close enough to said proximate edge when in its inactive condition as not to interfere with such manipulation of such sheet material.

* * * * *

UNITED STATES PATENT OFFICE

CERTIFICATE OF CORRECTION

Patent No. 4 223 511 Dated September 23, 1980

Inventor(s) John W. Black

It is certified that error appears in the above-identified patent and that said Letters Patent are hereby corrected as shown below:

Column 5, Line 46; change "place" to ---plate---.

Column 6, Line 53; change "claim 5" to ---claim 1---.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*